US006669173B1

(12) United States Patent
Dunn

(10) Patent No.: US 6,669,173 B1
(45) Date of Patent: Dec. 30, 2003

(54) DUAL PURPOSE PNEUMATIC FLOOR COVERING DEVICE

(76) Inventor: James R. Dunn, 4996 Standife Rd., Cohutta, GA (US) 30710

( * ) Notice: Subject to any disclaimer, the term of this patent is extended or adjusted under 35 U.S.C. 154(b) by 0 days.

(21) Appl. No.: 10/255,411

(22) Filed: Sep. 27, 2002

(51) Int. Cl.[7] ..... B65H 77/00
(52) U.S. Cl. ..... 254/201; 294/8.6
(58) Field of Search ..... 254/200, 201, 254/212, 209; 294/8.6

(56) References Cited

U.S. PATENT DOCUMENTS 1,094,449 A 4/1914 Lauri
4,008,879 A * 2/1977 Youngman ..... 254/201
4,230,302 A * 10/1980 Crain, Jr. ..... 254/212
5,288,057 A * 2/1994 Listau ..... 254/212
5,788,221 A 8/1998 Muhlebach et al.
5,894,705 A 4/1999 Sutton
5,938,182 A * 8/1999 Goodrich et al. ..... 254/209
6,370,836 B1 4/2002 Gunn
6,371,446 B1 * 4/2002 Gauthier et al. ..... 254/201

* cited by examiner

*Primary Examiner*—Emmanuel M Marcelo
(74) *Attorney, Agent, or Firm*—William B. Noll

(57) ABSTRACT

A dual purpose pneumatic floor covering device having two operating modes, one for straightening and laying wood slats, and a second for stretching and rendering taut carpeting. The device comprises a housing containing a pneumatic cylinder for applying axial pressure to a piston rod mounting a T-shaped member at one end of the housing, and a pivotal gripping member at an opposite end of the housing, where the gripping member is pivotal from an operating gripping mode to an inoperative mode.

5 Claims, 5 Drawing Sheets

DUAL PURPOSE PNEUMATIC FLOOR COVERING DEVICE

FIELD OF THE INVENTION

This invention relates to the field of floor covering implements, more particularly to a dual purpose, pneumatically operated device for applying a taut and uniform floor covering, such as wood slats and carpeting.

BACKGROUND OF THE INVENTION

The present invention is directed to a multi purpose device for laying a floor covering, such as wood slats and carpeting. In each case it is important to ensure a taut and uniform covering to enhance the appearance of the floor covering. Wood slats, such as interfitting, tongue and groove hard wood slats may be particularly difficult to lay as such slats may tend to be bowed from end to end. Floorboards provided with tongue and groove edges, or like mating edges, can be used to assemble a durable, high quality floor in a convenient and relatively simple manner. Tongue and groove floorboards generally fit together to form a joint in which a projecting rib on the edge of one board fits into the groove on the edge of another board. This type of interlocking joint aids in aligning the floorboards during assembly and also produces a strong, reliable union between the boards.

The floorboards may be assembled by gluing the floorboards together at the tongue and groove joint and/or by the use of a nailing gun to drive fasteners into the joint to the underlying floor substrate, typically plywood sheets. However, whatever the method of securing the floorboards, it is critical to ensure a straight alignment of the wood slats. Not only for the beauty of the newly laid floor covering, it is necessary to provide a tight seal at the joints to minimize damage to the floorboards from leaks, spillage and moisture.

In the early methods of laying such floorboards, technicians used a tapping block and hammer to ensure the alignment of wood slats. However, this often resulted in damage to the joints. As a result, the prior art developed different systems, such as gripping devices, to avoid the damage. Certain of such prior art devices are described and illustrated in the following U.S. Patents:

a.) U.S. Pat. No. 6,370,836, to Gunn, teaches an apparatus for compressing floor boards where the apparatus comprises a first plate including a first edge gripping device for gripping an edge of a first floor board, and a compression biasing device such as a coil spring or bungee cord mounted on the first plate. A second plate includes a second edge gripping device for gripping an edge of a second floor board, and a strap clamp. A compression strap is joined at its proximal end with the biasing device and extends, in parallel juxta position to the first and second floor boards, for terminating, and removably engaging the strap clamp, such that the biasing device causes the first and second plates to draw the first and second floor boards, as well as any intermediate boards, into compression.

b.) U.S. Pat. No. 5,894,705, to Sutton, relates to a floor installation clamp comprising a clamp used for joining floorboards. The clamp includes a tension member with a first end and a second end. The tension member is connectable to opposing counterstays. One or both counterstays of the clamp may comprise suction devices removably attachable floorboard surfaces. Alternatively, the opposing counterstay may comprise an end piece that is removably attachable to a floorboard edge.

c.) U.S. Pat. No. 5,788,221, to Muhlebach et al., discloses a multi-part gripping device for pressing together flooring elements, such as laminates and finished parquet, in side-by-side relationship. The device includes two rod parts that are axially and telescopically connected, one of said rod parts including a pressure jaw at an end having parallel shoulders that extend toward the other rod part, the shoulders being at a different spacing from the associated rod part for abutting a base portion of a flooring element over which the gripping device is positioned. A longitudinally adjustable lead screw is pivotally connected between the two rod parts for moving the two rod parts together, such that a connecting pressure is applied to a flooring element being interconnectably positioned adjacent one or more previously positioned flooring elements.

d.) U.S. Pat. No. 1,094,449, to Lauri, describes a slat straightening tool that includes a manually operated cylinder having a pair of reversely threaded rods within the cylinder, where the cylinder contains a series of openings for receiving a removably inserted lever to turn the cylinder and either axially extend or retract the pressure applying rods.

The foregoing prior art systems offer some assistance in securing wood slats over a subfloor, but none offer the versatility of the present invention in providing a pneumatic device that can be used for both laying and straightening wood slats, such as hard wood slats, and carpeting, where a taut and uniform floor covering is critical to an aesthetically pleasing floor covering. The dual functioning device hereof will become more apparent in the description which follows, especially when considered in conjunction with the accompanying drawings.

SUMMARY OF THE INVENTION

This invention teaches a dual functioning device for laying a taut and uniform floor covering, particularly wood slats and carpeting. The device, as later described, can be used without modification for either wood slats or carpeting by merely reversely orienting the device. In either case, the device comprises a housing mounting a pneumatic cylinder that provides the axial driving force in straightening a bowed wood slat, or in stretching and maintaing taut a carpeting section. A first end of the housing includes a pivotal gripping member mounting for removably contacting a subfloor, or for digging into the carpeting knap to stretch the carpeting. The opposite end of the housing mounts a T-shaped plate, at the end of the axially movable piston rod, for applying pressure to a bowed slat or restraining member, such as a wall or 2×4 boards between the device and a fixed wall.

Accordingly, a feature of the invention is a dual functioning device for laying a floor covering, such as wood slats and carpeting.

Another feature hereof is the provision of the use of a pneumatic cylinder for applying pressure in the starightening of a bowed wood slat, or in stretching and maintaining taut a carpeting section.

Still a further feature of the invention lies in the use of a pivotal gripping member for moving between operative and inoperative positions.

These and other features of the invention will become more apparent in the further description which follows, especially when considered in conjunction with the accompanying drawings.

DETAILED DESCRIPTION OF PREFERRED EMBODIMENT

Figure 1:
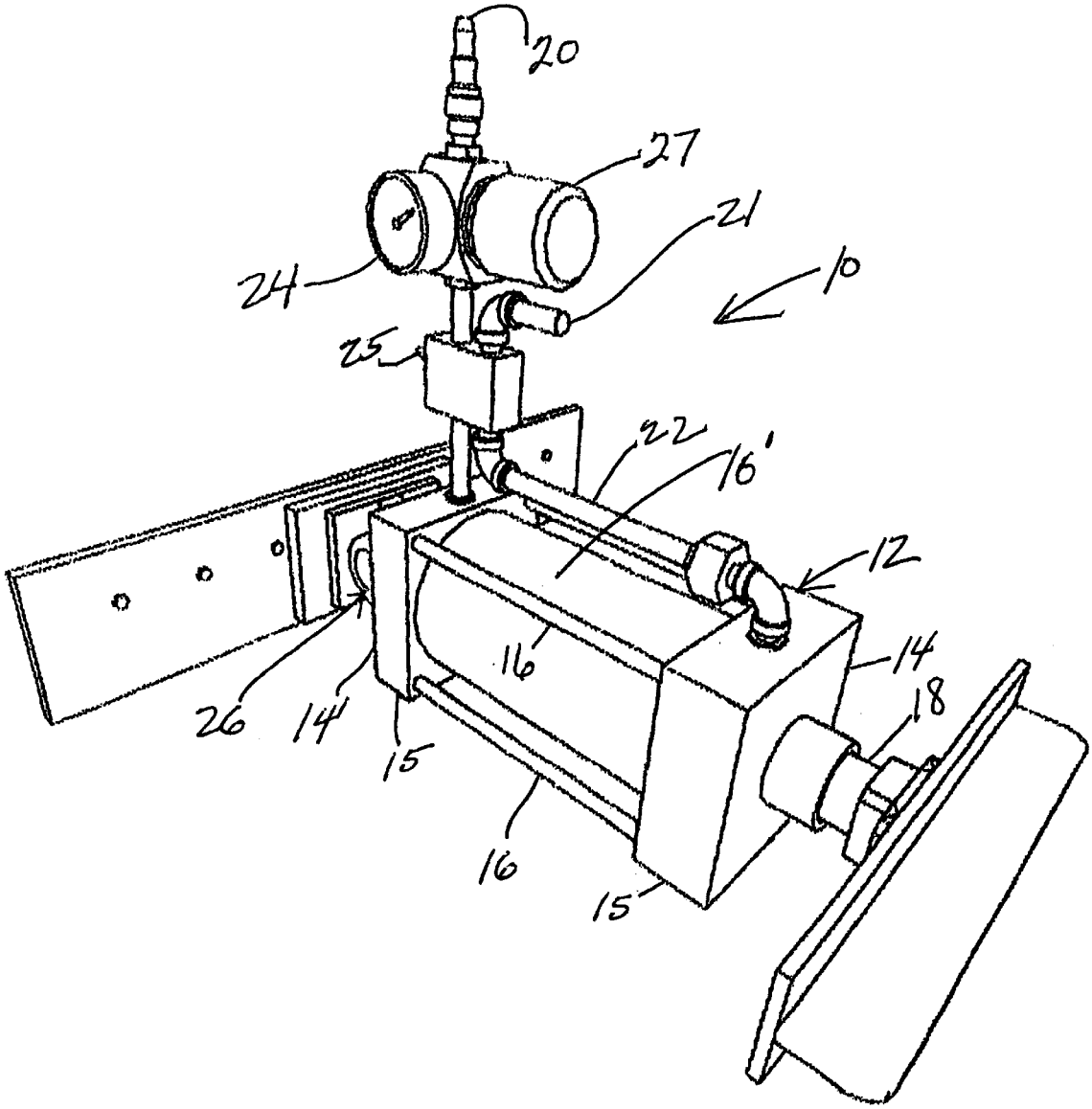
FIG. 1 is a top/front perspective view of the dual purpose, pneumatically operated device for rendering a floor covering taut and uniform according to the present invention.

The present invention is directed to a dual functioning floor laying device that has particular utility in straightening wood slat, that typically may reveal a bow throughout its length, and to laying and stretching carpeting. The dual functioning device will now be described with regard to the accompanying drawings, where like reference numerals represent like components or features throughout the several views.

Turning first to the embodiment of FIGS. 1 through 4, illustrating various views of the device 10, the Figures show a housing support 12 consisting of a pair of end members 14, 14', where the respective end members feature a planar base 15 to be supported on a subfloor, and plural rod supports 16 extending between the end members 14, 14'. The housing support 12 mounts a pneumatic cylinder 16' capable of applying an axial pressure by piston 17 with a sealing O-ring 19 along piston rod 18 extending through end member 14, see in particular FIG. 3. In support of the operating pneumatic cylinder 16, the device includes an air intake line 20, an air exhaust valve 21, communicating with the cylinder through piping 22, an air pressure gauge 24, an operating ON/OFF switch 25, and air pump 27 with electrical power connection 29 for powering by a generator or structure current, see FIG. 4.

Figure 2:
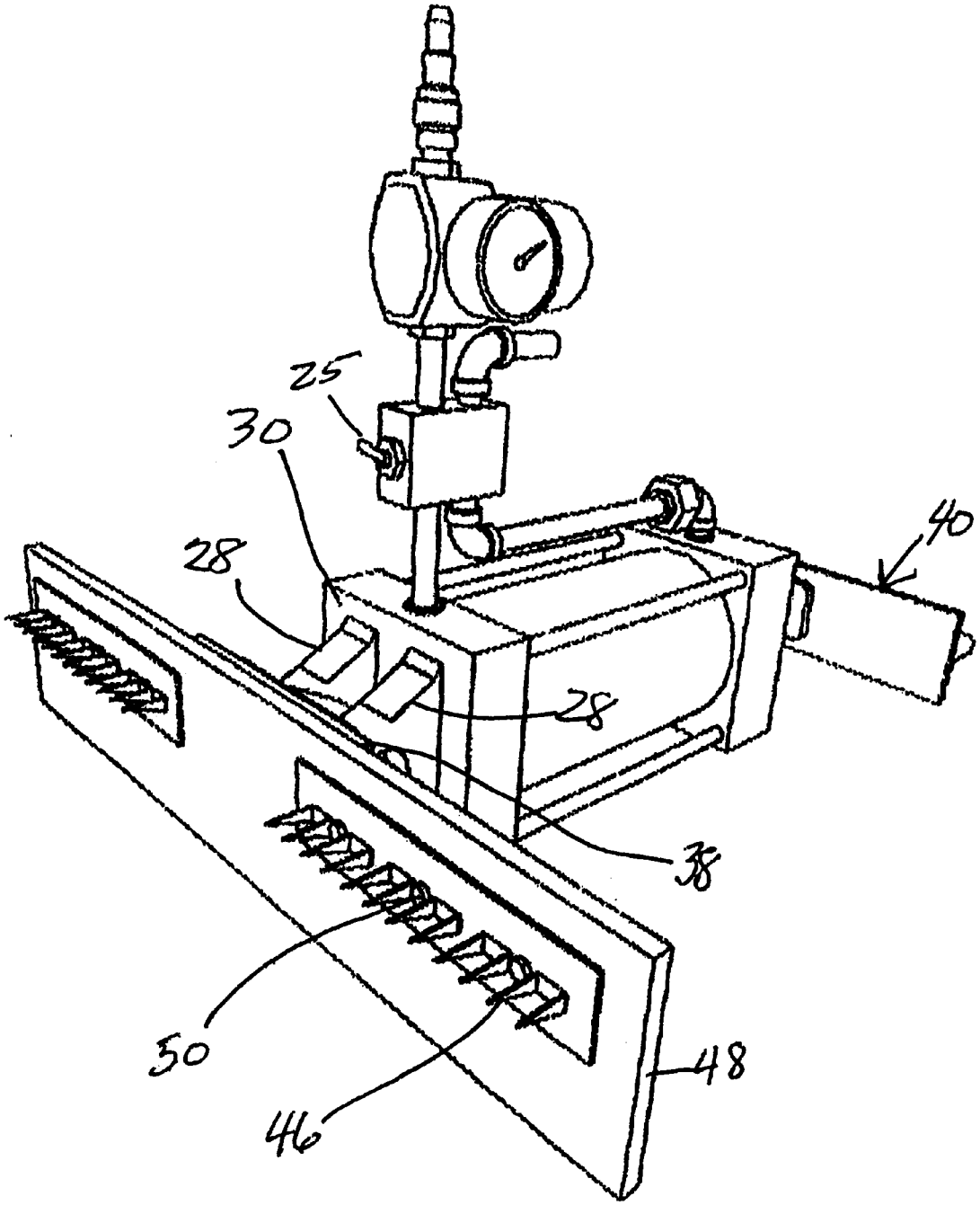
FIG. 2 is a top/rear perspective view of the device of FIG. 1.
Figure 3:
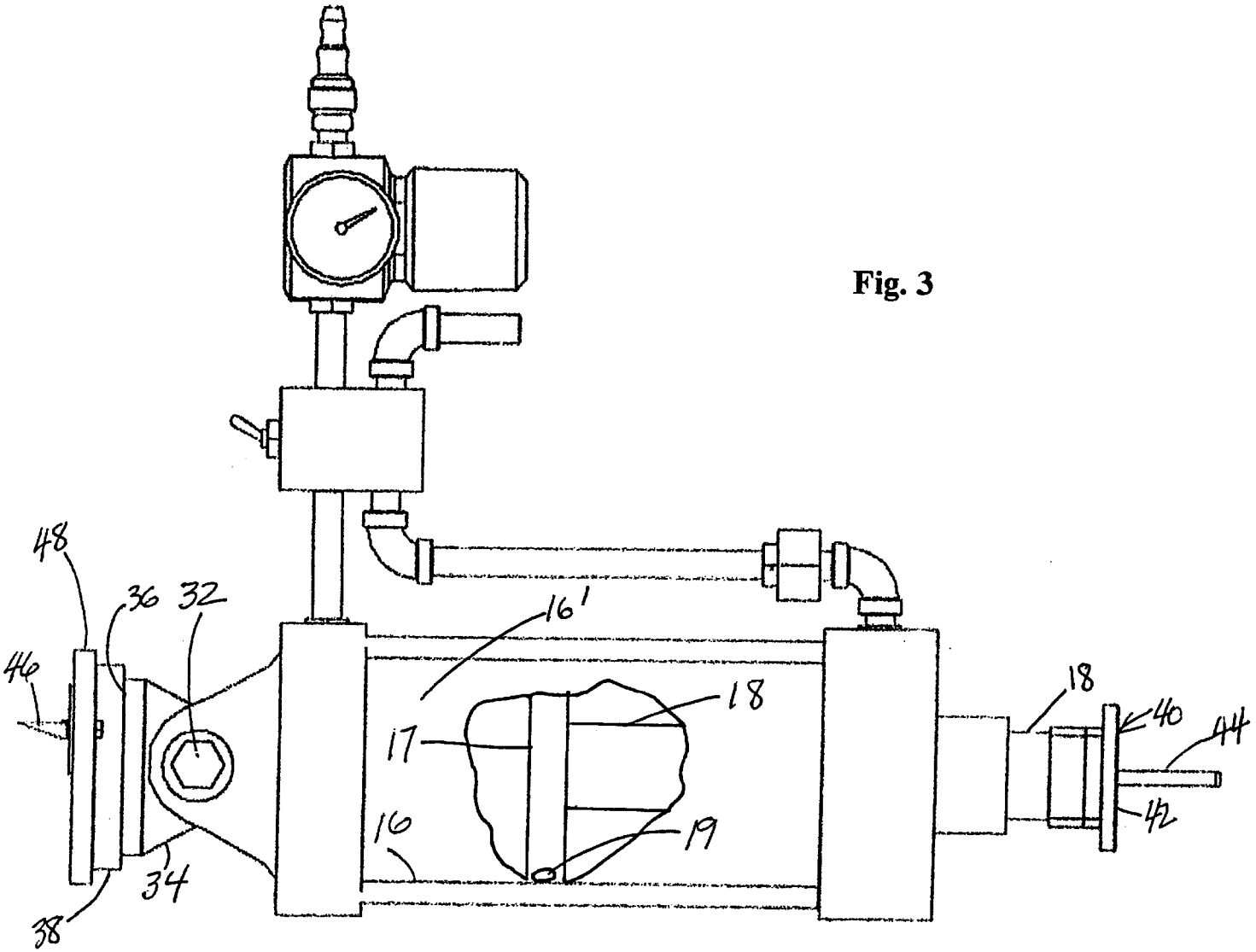
FIG. 3 is a side view of the device of FIG. 2 with portions removed to reveal internal details of the pneumatic cylinder of the device.
Figure 4:
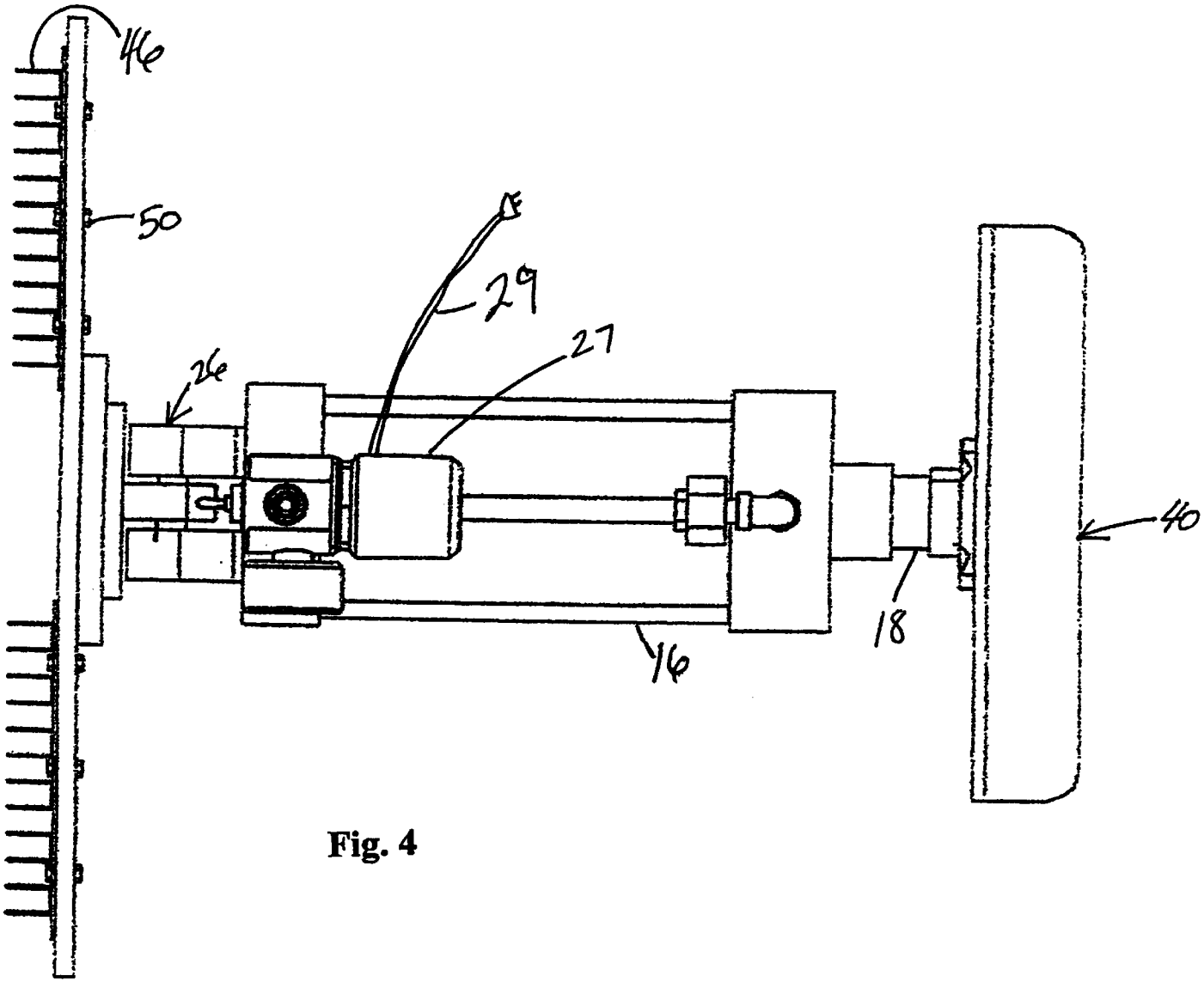
FIG. 4 is a top view of the invention device hereof.

Mounted to the end member 14', as best seen in FIGS. 2 and 3, is a pivotal gripping member 26, where the gripping member is shown in the inoperative mode. The gripping member 26 comprises a fixed element, or preferably a pair of spaced apart elements 28, secured to the outer wall 30 of end member 14', where the one or a pair of elements 28 includes an opening for receiving a pivot pin 32. Mounted for pivotal movement on said pin 32, relative to said elements 28, is an extension member 34. The extension member 34 features a flat outer face 36 to which may be secured a planar gripping plate 38, as more fully discussed later.

The opposite end of the device 10, in pressure applying relationship with the piston rod 18, is a T-shaped member 40 that comprises a base 42 and a laterally extending plate 44, where the base 42 is the component for contacting the bowed slats in laying a hard wood floor composed of plural slats laid side by side.

Returning to the opposite end of the device, specifically the pivotal gripping member 26, the member is provided with an array of gripping teeth 46 (FIGS. 2–4), that are mounted to a base plate 48 which in turn is bolted to the outer face 36 of gripping member 26, such as by threaded fasteners 50, as known in the art. In operation, the device 10 may be positioned in contact with the wood slat upon which the operation is to take place, then the gripping member 26 is pivoted to bring the gripping teeth 46 into holding contact with the subfloor. Thereafter, the pneumatic cylinder is activated to axially drive the piston rod 18 and T-shaped member 40 toward and against the wood slat. As the wood slat is held in a straightened position, it may be anchored to the adjoining wood slat or subfloor.

A unique facet of this invention is its ability to function in straightening wood slats, as discussed above, or in stretching and maintaining taut a carpeting section. To do the latter, the device 10 is reversely oriented. In laying carpet, a reversely oriented tacking strip is nailed to the floor subfloor with plural tacks extending upward for engaging and holding the carpet base. The carpet is initially secured to the tacking strip, but then the carpet must be stretched across the room to a tacking strip adjacent the opposite wall. The problem is to get the carpeting stretched between the opposing walls. With the present device, the gripping member 26 is pivoted into contact with the carpet knap for applying a stretching pressure to the carpet, while the T-shaped member 40 is restrained by a wall or against an intervening member, such as a pair of 2×4 boards between the device 10 and a wall. As an alternative to a fixed length intervening member, it may be desirable to use an adjustable length support. Such adjustable support member may be a light weight, telescopic tubing mechanism. For example, the mechanism may comprise several, i.e. three, sections that may be extended over selected lengths that uses a spring catch, as known in the art, to fix the mechanism at the desired length. In all cases, the carpeting section is stretched into a taut and uniform manner.

Figure 5:
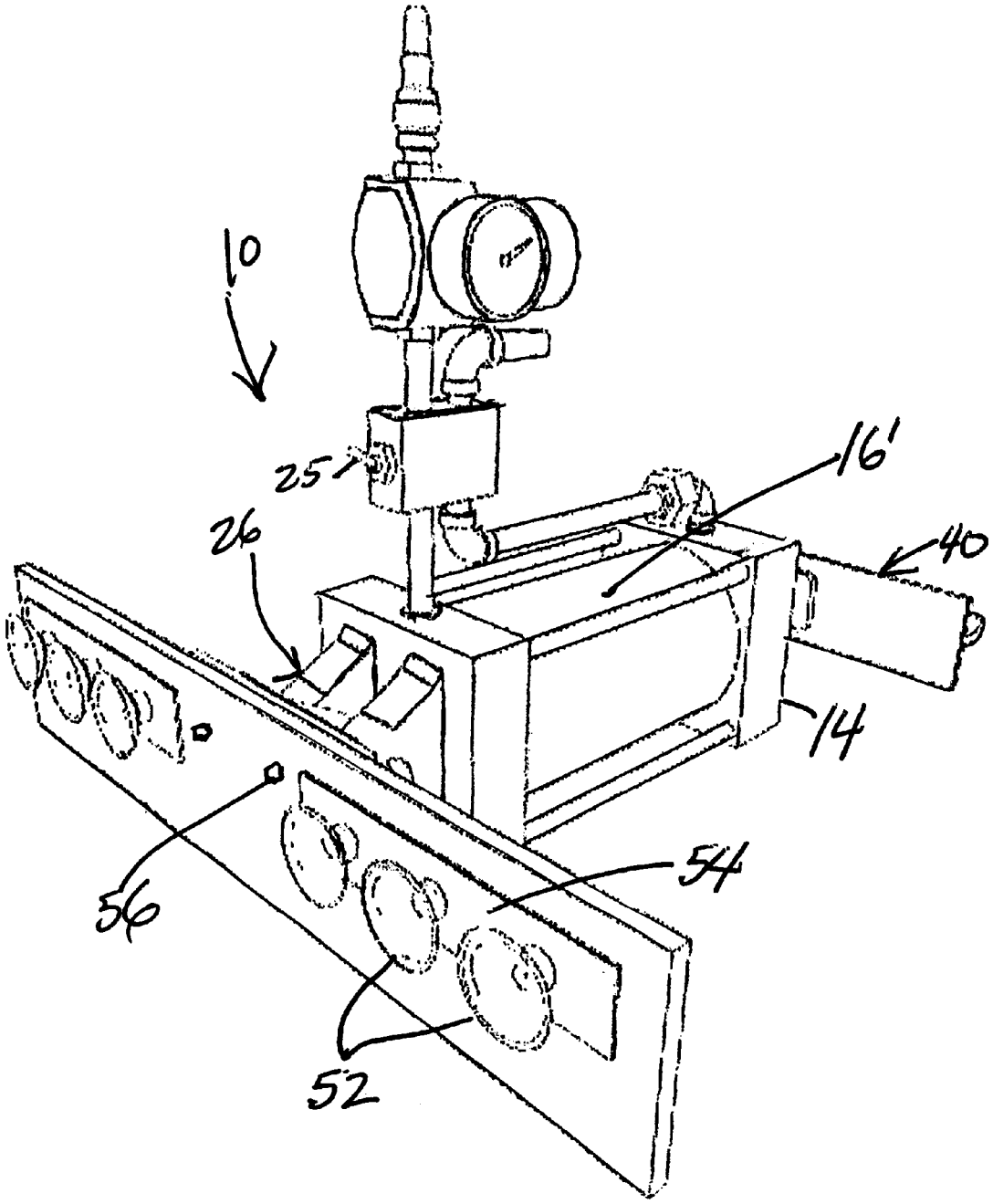
FIG. 5 is a top/rear perspective, similar to FIG. 2, showing an alternative anchoring means, specially a series of suction cups, for removably anchoring the device hereof to a flat subfloor.

Often a new flooring system must be laid onto a subfloor that is not amenable to gripping by the gripping teeth 46 extending from the base plate 48, such as a concrete slab, smooth slate or other similar surface. In such a case, the gripping teeth may be replaced by a series of suction cups 52 (FIG. 5), mounted to a base plate 54. The base plate 54 may be removably secured to the outer face 36 by means of fastening members 56. To operate, the gripping member 26 is merely pivoted into contact with the smooth floor and operated in the manner discussed above.

It is recognized that changes, variations and modifications may be made to the dual purpose pneumatic floor covering device of this invention without departing from the spirit and scope thereof. Accordingly, no limitation is intended to be imposed on the invention except as set forth in the accompanying claims.

I claim:

1. A dual functioning floor covering device operable in a first mode for straightening wood slats of the tongue and groove type, and operable in a second mode for stretching carpeting, said device comprising:

a.) a housing support mounting a pneumatic cylinder for exerting axial pressure on a piston rod having a T-shaped plate member secured thereto, b.) a pivotal member remotely secured to said housing from said T-shaped plate member, where said pivotal member mounts a first planar plate and a second planar plate removably secured thereto, said second planar plate having an outer face containing means for removably securing said device to an underlying supporting surface, said means being a mechanism selected from the group consisting of (a) an array of protruding gripping teeth on said outer face, and (b) plural suction cups on said outer face for removably securing said device to a smooth floor; and, c.) means for activating and monitoring said pneumatic cylinder.

2. The dual functioning floor covering device according to claim 1, wherein said means for activating and monitoring said pneumatic cylinder includes an air pump for moving a piston against said piston rod, an air intake line to said air pump, and an air exhaust valve from said cylinder.

3. The dual functioning floor covering device according to claim 1, wherein said second planar plate is secured to said first planar plate by plural fastening members.

4. The dual functioning floor covering device according to claim 1, wherein said second planar plate is secured to said first planar plate by plural fastening members.

5. The dual functioning floor covering device according to claim 4, wherein said housing includes a pair of end members featuring a flat surface for sliding movement along a surface during operation of said device.

* * * * *